US005389508A

United States Patent [19]

Takada et al.

[11] Patent Number: 5,389,508

[45] Date of Patent: Feb. 14, 1995

[54] SILVER HALIDE PHOTOGRAPHIC LIGHT-SENSITIVE MATERIAL

[75] Inventors: Shunji Takada; Morio Yagihara; Hisashi Okamura; Hiroshi Kawamoto; Makoto Kikuchi, all Minami-Ashigara, Japan

[73] Assignee: Fuji Photo Film Co., Ltd., Kanagawa, Japan

[21] Appl. No.: 34,860

[22] Filed: Mar. 19, 1993

[30] Foreign Application Priority Data

Mar. 19, 1992 [JP] Japan ..... 4-092342

[51] Int. Cl.[6] ..... G03C 1/015; G03C 1/005

[52] U.S. Cl. ..... 430/367; 430/569

[58] Field of Search ..... 430/567, 569

[56] References Cited

U.S. PATENT DOCUMENTS 4,581,328 4/1986 Matsuyama ..... 430/567

FOREIGN PATENT DOCUMENTS 0368275 5/1990 European Pat. Off. .

268538 3/1990 Japan .

*Primary Examiner*—Charles L. Bowers, Jr.

*Assistant Examiner*—Mark F. Huff

*Attorney, Agent, or Firm*—Sughrue, Mion, Zinn, Macpeak & Seas

[57] ABSTRACT

A silver halide photographic light-sensitive material comprising at least one light-sensitive silver halide emulsion layer formed on a support. The emulsion layer containing at least one silver halide emulsion which comprises regular-crystal grains having a silver halide phase containing silver iodide. The silver halide phase has been formed while iodide ions are rapidly being generated.

8 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material.

More specifically, the present invention relates to a silver halide photographic light-sensitive material improved photographic properties such as fog and sensitivity.

2. Description of the Related Art

Recently, a demand for photographic silver halide emulsions has been increasingly strict, and higher-level demands have arisen for photographic properties, such as high sensitivity and low fog.

It is considered preferable in terms of uniformity of chemical sensitization that silver iodide (iodide ion) contents be uniform within individual grain as well as among grains in order to increase the sensitivity of the grains.

JP-A-2-68538 (Japanese Patent Appln. No. 63-220187) discloses the technique of eliminating a non-uniform distribution of halide within individual grain and among grains by using, as a halogen ion supply source, either a halogen ion-releasing agent or silver halide fine grains in order to form grains in the process of forming silver halide grains, in place of an aqueous halogen salt solution which is conventionally used. ("JP-A" means Published Unexamined Japanese Patent Application.)

However, the regular-crystal silver halide grains formed through the use of the technique disclosed in this publication are still unsatisfactory to meet the above requirements, i.e., a sufficient decrease in fog and a high sensitivity.

JP-A-2-68538 does not disclose that, to prepare an emulsion which is improved in fog and sensitivity, it is important to form regular-crystal silver halide grains having a silver halide phase containing silver iodide, while iodide ions are rapidly being generated.

SUMMARY OF THE INVENTION

The above object of the present invention is achieved by a silver halide photographic light-sensitive material comprising at least one light-sensitive silver halide emulsion layer formed on a support, the emulsion layer containing at least one silver halide emulsion which comprises regular crystal grains having a silver halide phase containing silver iodide, the silver halide phase having been formed while iodide ions are rapidly being generated in a reactor vessel.

In one embodiment, 60% or more of the surface of each regular crystal grain may be (111) face or (100) face.

In a preferred embodiment, the iodide ions are generated from an iodide ion-releasing agent placed in the reactor vessel, and 100% to 50% of the iodide ion-releasing agent completes release of iodide ions within 180 consecutive seconds in the reactor vessel. Usually, the iodide ions are generated from the iodide ion-releasing agent upon reacting with an iodide ion release-controlling agent. The reaction can be expressed as a second-order reaction essentially proportional to a concentration of the iodide ion-releasing agent and a concentration of the iodide ion release controlling agent, and a rate constant of the second-order reaction is 1,000 to $5\times10^{-3}M^{-1}sec^{-1}$.

Generally, the iodide ion-releasing agent is represented by Formula (I):

R—I where R represents a monovalent organic residue which releases the iodine atom in the form of ions upon reacting with a base and/or a nucleophilic reagent.

DETAILED DESCRIPTION OF THE PREFERRED EMBODIMENTS

The present invention will be described in more detail below.

The iodide ion-releasing agent represented by the formula (I) of the present invention overlaps in part compounds used to obtain a uniform halogen composition in each silver halide grain and between individual grains in JP-A-2-68538 described above.

It is, however, totally unexpected that the present inventors has found that a silver halide emulsion having a low fog and a high sensitivity can be obtained by performing formation of silver halide grains while iodide ions are rapidly being generated in the presence of an iodide ion-releasing agent represented by the formula (I).

An iodide ion-releasing agent represented by the following formula (I) of the present invention will be described in detail.

R—I Formula (I)

wherein R represents a monovalent organic residue which releases the iodine atom in the form of iodide ion upon reacting with a base and/or a nucleophilic reagent.

The details of a compound represented by the formula (I) will be described further. Preferable examples of R are an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, a heterocyclic group having 4 to 30 carbon atoms, an acyl group having 1 to 30 carbon atoms, a carbamoyl group, an alkyl or aryloxycarbonyl group having 2 to 30 carbon atoms, an alkyl or arylsulfonyl group having 1 to 30 carbon atoms, and a sulfamoyl group.

R is preferably one of the above groups having 20 or less carbon atoms, and most preferably one of the above groups having 12 or less carbon atoms.

Groups each having the number of carbon atoms, which falls within this range, are preferable in view of their solubility and the amount in which they are used.

It is also preferable that R be substituted, and examples of preferable substituents are as follows. These substituents may be further substituted by other substituents.

Examples of the substituents are a halogen atom (e.g., fluorine, chlorine, bromine, or iodine), an alkyl group (e.g., methyl, ethyl, n-propyl, isopropyl, t-butyl, n-octyl, cyclopentyl, or cyclohexyl), an alkenyl group (e.g., allyl, 2-butenyl, or 3-pentenyl), an alkynyl group (e.g., propargyl or 3-pentynyl), an aralkyl group (e.g., benzyl or phenethyl), an aryl group (e.g., phenyl, naphthyl, or 4-methylphenyl), a heterocyclic group (e.g., pyridyl, furyl, imidazolyl, piperidyl, or morpholyl), an alkoxy group (e.g., methoxy, ethoxy, or butoxy), an aryloxy group (e.g., phenoxy or naphthoxy), an amino group (e.g., unsubstituted amino, dimethylamino, ethylamino, or anilino), an acylamino group (e.g., acetylamino or benzoylamino), a ureido group (e.g., unsubstituted ureido, N-methylureido, or N-phenylureido), a urethane group (e.g., methoxycarbonylamino or phenoxycarbonylamino), a sulfonylamino group (e.g., methylsulfonylamino or phenylsulfonylamino), a sulfamoylamino group (e.g., sulfamoyl, N-methylsulfamoyl, or N-phenylsulfamoyl), a carbamoyl group (e.g., carbamoyl, diethylcarbamoyl, or phenylcarbamoyl), a sulfonyl group (e.g., methylsulfonyl or benzenesulfonyl), a sulfinyl group (e.g., methylsulfinyl or phenylsulfinyl), an alkyloxycarbonyl group (e.g., methoxycarbonyl or ethoxycarbonyl), an aryloxycarbonyl group (e.g., phenoxycarbonyl), an acyl group (e.g., acetyl, benzoyl, formyl, or pivaloyl), an acyloxy group (e.g., acetoxy or benzoyloxy), an amidophosphoryl group (e.g., N,N-diethylamido-phosphoryl), an alkylthio group (e.g., methylthio or ethylthio), an arylthio group (e.g., a phenylthio), a cyano group, a sulfo group, a carboxyl group, a hydroxy group, a phosphono group, or a nitro group.

More preferable substituents for R are a halogen atom, an alkyl group, an aryl group, a 5- or 6-membered heterocyclic group containing at least one O, N, or S, an alkoxy group, an aryloxy group, an acylamino group, a sulfamoyl group, a carbamoyl group, an alkylsulfonyl group, an arylsulfonyl group, an aryloxycarbonyl group, an acyl group, a sulfo group, a carboxyl group, a hydroxy group, and a nitro group.

Most preferable substituents for R are a hydroxy group, a carbamoyl group, a lower-alkyl sulfonyl group, and a sulfo group (including its salt), when substituted on an alkylene group, and a sulfo group (including its salt), when substituted on a phenylene group.

A compound represented by the formula (I) of the present invention is preferably a compound represented by the following formula (II) or the following formula (III).

A compound represented by Formula (II) of the present invention will be described below.

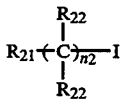

Formula (II)

In the formula (II), $R_{21}$ represents an electron-withdrawing group and $R_{22}$ represents a hydrogen atom or a substitutable group.

$n_2$ represents an integer from 1 to 6. $n_2$ is preferably an integer from 1 to 3, and more preferably 1 or 2.

The electron attractive group represented by $R_{21}$ is preferably an organic group having a Hammett $\sigma_p$, $\sigma_m$, or $\sigma_I$ value greater than 0.

The Hammett $\sigma_p$ or $\sigma_m$ value is described in "Structural Activity Correlation of Chemicals" (Nanko Do), page 96 (1979), and the Hammett $\sigma_I$ value is described in the same literature, page 105. So the values can be selected on the basis of these tables.

Preferable examples of $R_{21}$ are a halogen atom (e.g., fluorine, chlorine, or bromine), a trichloro methyl group, a cyano group, a formyl group, a carboxylic acid group, a sulfonic acid group, a carbamoyl group (e.g., unsubstituted carbamoyl or diethylcarbamoyl), an acyl group (e.g., an acetyl group or a benzoyl group), an oxycarbonyl group (e.g., a methoxycarbonyl group or an ethoxycarbonyl group), a sulfonyl group (e.g., a methanesulfonyl group or a benzenesulfonyl group), a sulfonyloxy group (e.g., a methanesulfonyloxy group), a carbonyloxy group (e.g., an acetoxy group), a sulfamoyl group (e.g., a nonsubstituted sulfamoyl group or a dimethylsulfamoyl group), and a heterocyclic group (e.g., a 2-thienyl group, a 2-benzoxazolyl group, a 2-benzothiazolyl group, a 1-methyl-2-benzimidazolyl group, a 1-tetrazolyl group, or a 2-quinolyl group). Carbon-containing groups of $R_{21}$ preferably contain 1 to 20 carbon atoms.

Examples of the substitutable group represented by $R_{22}$ are those enumerated above as the substituents for R.

It is preferable that one-half or more of $R_{22}$'s contained in a compound represented by the formula (IV) be hydrogen atoms. $R_{22}$'s present in a molecule may be the same or different.

$R_{21}$ and $R_{22}$ may be further substituted, and preferable examples of the substituents are those enumerated above as the substituents for R.

Also, $R_{21}$ and $R_{22}$ or two or more $R_{22}$'s may combine together to form a 3- to 6-membered ring.

A compound represented by the formula (III) of the present invention will be described below.

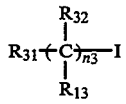

Formula (III)

In the formula (V), $R_{31}$ represents an $R_{33}O$— group, an $R_{33}S$— group, an $(R_{33})_2N$— group, an $(R_{33})_2P$-group, or phenyl, wherein $R_{33}$ represents a hydrogen atom, an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, or a heterocyclic group having 4 to 30 carbon atoms.

Groups each having the number of carbon atoms, which falls within this range, are preferable in view of their solubility and the amount in which they are used.

If $R_{31}$ represents a $(R_{33})_2N$— group or a $(R_{33})_2P$— group, two $R_{33}$ groups may be the same or different. $R_{31}$ is preferably the $R_{33}O$— group.

$R_{33}$ and n3 have the same meanings as $R_{22}$ in the formula (IV), and a plurality of $R_{33}$'s may be the same or different. Examples of the substitutable group represented by $R_{33}$ are those enumerated above as the substituents for R. $R_{33}$ is preferably a hydrogen atom.

$n_3$ is preferably 1, 2, 4, or 5, and more preferably 2.

$R_{31}$ and $R_{33}$ may be further substituted. Preferable examples of the substituents are those enumerated above as the substituents for R.

Also, $R_{31}$ and $R_{33}$, or two or more $R_{33}$'s may bond together to form a ring.

Specific examples of the compounds represented by the Formulas (I), (II), and (III) of the present invention will be described below, but the present invention is not limited to these examples.

| | |
|---|---|
| $ICH_2COOH$ | (1) |
| $ICH_2CONH_2$ | (2) |
| $ICH_2CN$ | (3) |
| $I(CH_2)_2COOH$ | (4) |
| $I(CH_2)_3COOH$ | (5) |

-continued
(6)
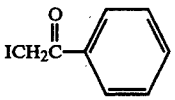
(7)
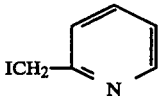
(8)
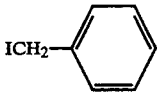
(9) $I(CH_2)_2SO_3Na$
(10) $I(CH_2)_2SO_2CH_3$
(11) $I(CH_2)_2OH$
(12) $I(CH_2)_3OH$
(13) $I(CH_2)_4OH$
(14) $ICH_2CHOH$ | $CH_3$
(15) $ICH_2CHOH$
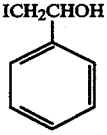
(16) $ICH_2CHCH_2OH$ | OH
(17) $ICH_2CHCH_2SO_3Na$ | OH
(18)
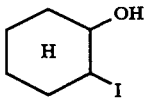
(19) $ICH_2CHCHCH_2I$ | | OHOH
(20)
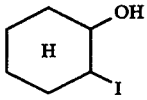
(21) ICHCOOH
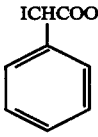
(22) $I(CH_2)_2SO_2CH_2CONH_2$
(23) $I(CH_2)_2NH_2$
(24) $I(CH_2)_2NHSO_2CH_3$
(25) $I(CH_2)_2NHCOCH_3$
(26) $I(CH_2)_2OCH_3$
(27) $I(CH_2)_2SCH_3$
(28)
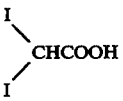
(29) $ICH_2CHCH_2I$ | OH
-continued
(30) $I(CH_2)_2SO_2NH_2$
(31)
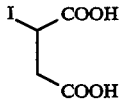
(32)
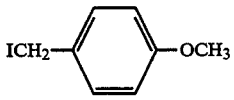
(33)
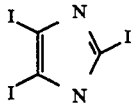
(34)
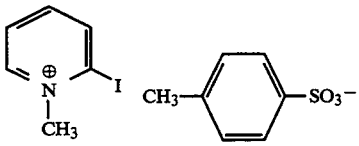
(35)
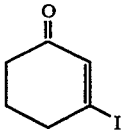
(36)
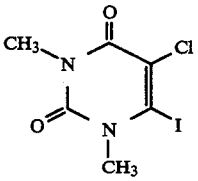
(37)
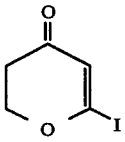
(38)
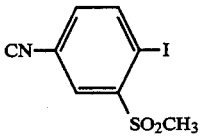
(39)
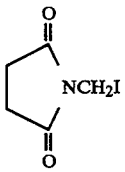
(40)
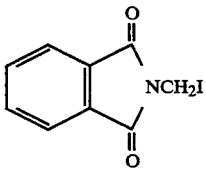
(41)
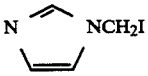

-continued
(42)
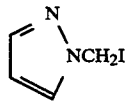
(43)
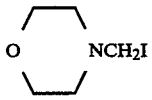
(44)
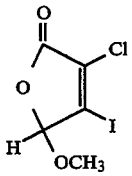
(45)
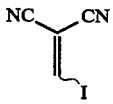
(46)
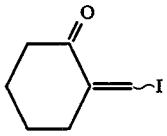
$I(CH_2)_5COOH$ (47)
(48)
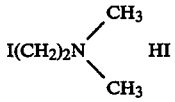
$I(CH_2)_2N(CH_3)SO_2CH_3$ (49)
$I(CH_2)_2OCOCH_3$ (50)
$I(CH_2)_2N(CH_3)COCH_3$ (51)
(52)
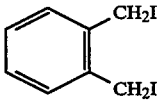
(53)
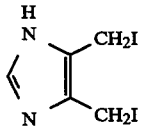
(54)
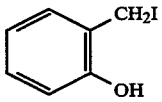
(55)
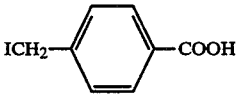
(56)
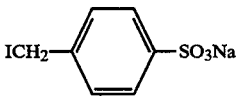
$[CH_2CONH(CH_2)_2—SO_3Na]$ (57)
-continued
(58)
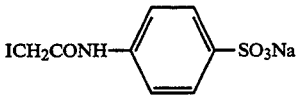
(59)
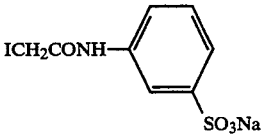
(60)
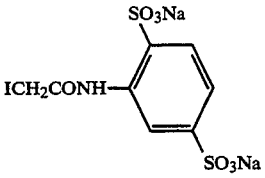
(61)
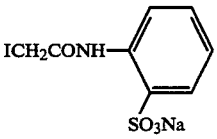
(62)
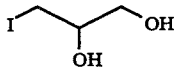
(63)
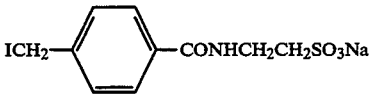
(64)
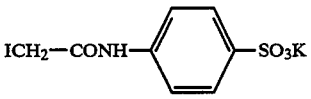
(65)
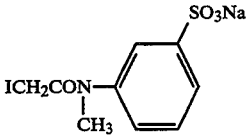
(66)
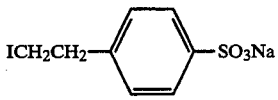
(67)
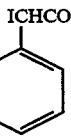
(68)
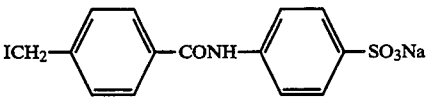
(69)
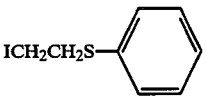
The iodide ion-releasing agent of the present invention can be synthesized in accordance with the synthesizing methods disclosed in J. Am. Chem. Soc., 76, 3227-8 (1954), J. Org. Chem., 16, 798 (1951), Chem. Ber., 97, 390 (1964), Org. Synth., V, 478 (1973), J. Chem. Soc., 1951, 1851, J. Org. Chem., 19, 1571 (1954), J. Chem. Soc., 1952, 142, J. Chem. Soc., 1955, 1383, Angew, Chem., Int. Ed., 11,229 (1972), Chem Commu., 1971, 1112.

The iodide ion-releasing agent of the present invention releases iodide ion upon reacting with an iodide ion release-controlling agent (a base and/or a nucleophilic reagent). Preferable examples of the nucleophilic reagent for this purpose are chemical species listed below:

Hydroxide ion, sulfite ion, hydroxylamine, thiosulfate ion, metabisulfite ion, hydroxamic acids, oximes, dihydroxybenzenes, mercaptanes, sulfinate, carboxylate, ammonia, amines, alcohols, ureas, thioureas, phenols, hydrazines, hydrazides, semicarbazides, phosphines, and sulfides.

In the present invention, the rate and time at which iodide ion is released can be controlled by controlling the concentration of a base or a nucleophilic reagent, the addition method, or the temperature of a reaction solution. A preferable example of the base is alkali hydroxide.

The range of concentration of the iodide ion-releasing agent and the iodide ion release-controlling agent for use in the rapid production of iodide ion is preferably $1\times10^{-7}$ to 20M, more preferably $1\times10^{-5}$ to 10M, further preferably $1\times10^{-4}$ to 5M, and most preferably $1\times10^{-3}$ to 2M.

If the concentration exceeds 20M, the total amount of the iodide ion-releasing agent and the iodide ion release-controlling agent, both having a great molecular weight, will be excessive for the volume of the grain formation vessel used. On the other hand, if the concentration is less than $1\times10^{-7}$M, the rate of reaction of releasing iodide ions will be too low, making it difficult to generate iodide ions rapidly.

The range of temperature is preferably 30° to 80° C., more preferably 35° to 75° C., and most preferably 35° to 60° C.

Generally, the rate of reaction of releasing iodide ions is too high at high temperatures over 80° C., and is too low at low temperatures below 30° C. The temperature range within which to use the iodide ion-releasing agent is therefore limited.

In the present invention, changes in pH of solution can be used if the base is used in releasing iodide ion.

In this case, the range of pH for controlling the rate and time at which iodide ions are released is preferably 2 to 12, more preferably 3 to 11, and particularly preferably 5 to 10. The pH is most preferably 7.5 to 10.0 after the control. Hydroxide ion determined by the ion product of water serves as a control agent even under a neutral condition of pH 7.

It is also possible to use the nucleophilic reagent and the base together. In this case, too, the rate and timing at which iodide ions are released may be controlled by controlling the pH within the above range.

The range of amount of iodide ions released from the iodide ion-releasing agent is preferably 0.1 to 20 mole %, more preferably 0.3 to 15 mole %, and most preferably 1 to 10 mole %.

The iodide ions can be released in any amount ranging from 0.1 to 20 mole % that is suitable for the purpose the ions are used. If the amount exceeds 20 mole %, however, the development speed will decrease in most cases.

When iodine atoms are to be released in the form of iodide ion from the iodide ion-releasing agent, iodine atoms may be either released completely or partially left undecomposed.

The rate at which iodide ions are released from the iodide ion-releasing agent will be described below by way of practical examples.

In the present invention, it is preferable to form a silver halide phase containing silver iodide on the edges of a tabular grain while rapidly generating iodide ions during the process of introducing dislocation lines into the tabular grain, in order to introduce dislocation lines at a high density. If the supply rate of iodide ion is too low, that is, if the time required to form a silver halide phase containing silver iodide is too long, the silver halide phase containing silver iodide dissolves again during the formation, and the dislocation-line density decreases. On the other hand, supplying iodide ion slowly is preferable in performing grain formation such that no nonuniformity is produced in a distribution of dislocation lines among individual grains.

It is therefore important that iodide ions be rapidly generated without causing any locality (nonuniform distribution). When the iodide ion-releasing agent or the iodide ion release-controlling agent to be used together therewith is added through an inlet to a reaction solution placed in a grain formation vessel, a locality with a high concentration of added agent may be formed near the inlet. Thus, correspondingly, a locality of generated iodide ions is produced, since the iodide ion release reaction proceeds very quickly.

The rate at which iodide ions released is deposited on a host grain is very high, and grain growth occurs in a region near the inlet of addition where the locality of the iodide ion is large. The result is grain growth nonuniform between individual grains. Therefore, the iodide ion-releasing rate must be selected so as not to cause locality of iodide ion.

In conventional methods (e.g., a method of adding an aqueous potassium iodide solution), iodide ion is added in a free state even when an aqueous potassium iodide solution is diluted before the addition. This limits the reduction in locality of iodide ion. That is, it is difficult for the conventional methods to perform grain formation without causing nonuniformity between grains. The present invention, however, which can control the iodide ion-releasing rate, makes it possible to reduce the locality of iodide ions compared to the conventional methods. In the example described above, dislocation lines can be introduced at a high density and uniformly between individual grains compared to the conventional methods by the use of the present invention capable of performing grain formation while iodide ions are rapidly being generated without causing any locality.

In the present invention, the iodide ion releasing rate can be determined by controlling the temperature and the concentrations of the iodide ion-releasing agent and the iodide ion release-controlling agent and therefore can be selected in accordance with the intended rise.

In the present invention, a preferable iodide ion-releasing rate is the one at which 100 to 50% of the total weight of the iodide ion-releasing agent present in a reaction solution in a grain formation vessel complete release of iodide ion within 180 consecutive seconds, more preferably within 120 seconds, and most preferably within 60 seconds.

Preferably, the iodide ions should be released over at least 1 second.

The words "180 consecutive seconds" means a period for which the reaction of releasing iodide ions continues. The iodide ion-releasing period may be measured, starting at any time during the continuous reaction. If the iodide ions are released during two or more periods, set part from one another, the iodide ion releasing period may be measured, starting at any time during the first period or any other period. The ion releasing rate may be determined at said time during the first period or any other period.

A releasing rate at which the time exceeds 180 seconds is generally low, and a releasing rate at which the time exceeds less than 1 second is generally low. The releasing rate is limited. This similarly applies to a releasing rate at which the amount of the iodide ion-releasing agent is less than 50%.

A more preferable rate is the one at which 100 to 70% of the iodide ion-releasing agent present in a reaction solution in a grain formation vessel complete release of iodide ions within 180 consecutive seconds. The rate is further preferably the one at which 100 to 80%, and most preferably 100 to 90% complete release of iodide ions within 180 consecutive seconds.

"Completion of release of iodide ion" means that all the iodine contained in a particular iodide ion-releasing agent is released from the releasing agent in the form of ion. For example, in the case of an iodide ion-releasing agent having one iodine in the molecule, the release of iodide ion is completed when the one iodine is released from the releasing agent. In the case of an iodine ion-releasing agent having two or more iodines in the molecule, the release of iodide ion is completed when all of the two or more iodines are released therefrom.

When the reaction of rapidly producing iodide ion is represented by a second-order reaction essentially proportional to the concentration of the iodide ion-releasing agent and that of the iodide ion release-controlling agent (under water, 40° C.), the rate constant of the second-order reaction in the present invention is preferably 1,000 to $5\times10^{-3}$ ($M^{-1}$ $sec^{-1}$), more preferably 100 to $5\times10^{-2}$ ($M^{-1}$ $sec^{-1}$), and most preferably 10 to 0.1 ($M^{-1}$ $sec^{-1}$).

The "essentially second-order reaction" means that the coefficient of correlation is 1.0 to 0.8. The following are representative examples of a second-order reaction rate constant k ($M^{-1}$ $sec^{-1}$) measured under the conditions considered to be a pseudo first-order reaction—that is, the concentration of the iodide ion-releasing agent ranging from $10^{-4}$ to $10^{-5}$M, the concentration of the iodide ion release-controlling agent ranging from $10^{-1}$ to $10^{-4}$M, in water and at 40° C.

| Compound No. | Iodide Ion Release-Controlling Agent | k |
|---|---|---|
| 11 | Hydroxide ion | 1.3 |
| 1 | Sulfite ion | $1\times10^3$ or less |
| 2 | Sulfite ion | 0.29 |
| 58 | Sulfite ion | 0.49 |
| 63 | Sulfite ion | 1.5 |
| 22 | Hydroxide ion | 720 |

If k exceeds 1,000, the release is too fast to control; if it is less than $5\times10^{-3}$, the release is too slow to obtain the effect of the present invention.

The following method is favorable to control the release of iodide ions in the present invention.

That is, this method allows the iodide ion-releasing agent, added to a reaction solution in a grain formation vessel and already distributed uniformly, to release iodide ions uniformly throughout the reaction solution by changing the pH, the concentration of a nucleophilic substance, or the temperature, normally by changing from a low pH to a high pH.

It is preferable that alkali and the nucleophilic substance used together with alkali for increasing the pH during release of iodide ions be added in a condition in which the iodide ion-releasing agent is distributed uniformly throughout the reaction solution.

More specifically, in the present invention, iodide ions, which are to react with silver ions, are rapidly produced in a reaction system in order to form silver halide grains containing silver iodide (e.g., silver iodide, silver bromoiodide, silver bromochloroiodide, or silver chloroiodide). In most cases, the iodide ion-releasing agent of the present invention is added, if necessary along with another halogen ion source (e.g., KBr), to the reaction system which uses, as a reaction medium, an aqueous gelatin solution containing silver ions due to addition of, for example, silver nitrate, or containing silver halide grains (e.g., silver bromoiodide grains), and the iodide ion-releasing agent is distributed uniformly in the reaction system by a known method (such as stirring). At this stage the reaction system has a low pH value and is weakly acidic, and the iodide ion-releasing agent does not release iodide ions rapidly.

An alkali (e.g., sodium hydroxide or sodium sulfite) is then added, as an iodide ion release control agent, to the reaction system, thereby increasing the pH of the system to the alkaline side (preferably, to 7.5 to 10). As a result, iodide ions are rapidly released from the iodide ion-releasing agent. The iodide ions react with the silver ions or undergo halogen conversion with the silver halide grains, thus forming a silver iodide-containing region.

As has been indicated, the reaction temperature usually ranges from 30° to 80° C., more preferably 35° to 75° C., and most preferably 35° to 60° C. The iodide ion-releasing agent releases iodide ions usually at such a rate that 100 to 50% of the agent completes release of iodide ions within a consecutive period of 1 second to 180 seconds, starting at the time of adding the alkali. To make the iodide ion-releasing agent to release iodide ions at such a rate, which iodide ion-releasing agent and which iodide ion release control agent should be used in combination in what amounts they should be used are determined in accordance with the second-order reaction rate constant described above.

In order to distribute the alkali uniformly in the reaction system (that is, to produce silver iodide uniformly), it is desirable that the alkali be added while the reaction system is being vigorously stirred by means of, for example, controlled double jet method.

The emulsion grain of the present invention will be described below.

The emulsion grain of the present invention is a silver halide containing silver iodide.

The emulsion grain of the present invention contains at least one of a silver iodide phase, a silver bromoiodide phase, a silver bromochloroiodide phase, and a silver iodochloride phase. The emulsion grain may also contain another silver salt, e.g., silver rhodanite, silver sulfide, silver selenide, silver carbonate, silver phosphate, and an organic acid silver, as another grain or as a portion of the silver halide grain.

The range of silver iodide content of the emulsion grain of the present invention is preferably 0.1 to 20 mole %, more preferably 0.3 to 15 mole %, and most preferably 1 to 10 mole %.

The silver iodide content can be released in any amount ranging from 0.1 to 20 mole % that is suitable for the purpose the ions are used. If the amount exceeds 20 mole %, however, the development speed will decrease in most cases.

The effect of the present invention will be prominent if use is made of regular-crystal silver halide grains whose crystal phase and shape are specific and which are uniform in properties. In the case of a regular crystal, it is possible to use a cubic grain constituted by (100) faces, an octahedral grain constituted by (111) faces, or a dodecahedral grain constituted by (110) faces disclosed in JP-B-55-42737 or JP-A-60-222842. It is also possible to use, in accordance with the intended use of an emulsion, an (h11) face grain represented by a (211) face, an (hh1) face grain represented by a (331) face, an (hk0) face grain represented by a (210) face, or an (hk1) face grain represented by a (321) face, as reported in Journal of Imaging Science, vol. 30, page 247, 1986, although the preparation method requires some improvements. A grain having two or more different faces, such as a tetradecahedral grain having both (100) faces and (111) faces, a grain having (100) faces and (110) faces, or a grain having (111) faces and (110) faces can also be used in accordance with the intended use of an emulsion.

In the present invention, it is preferable that 60% or more of the surface each regular crystal grain is of (111) face or (100) face. When regular crystal grains of such a type were used, the advantages of the invention were prominent.

The percentage of (111) face or (100) face is determined by the method disclosed in T. Tani, Journal of Imaging Science 29, 165 (1985).

Regular crystal grains, 60% or more of the surface of which is either (111) face or (100) face, can be obtained by forming grains by controlled double jet method, i.e., one of simultaneous mixing methods, in which the pAg in the liquid phase of silver halide is maintained at a constant value by using an appropriate control electrical potential.

The emulsion grain of the present invention preferably has one of the following structures based on a halogen composition.

(1) A grain having one or more covering shells on a substrate grain:

It is preferable to form the core or the outermost shell of a double structure, a triple structure, a fourfold structure, a fivefold structure, . . . , or a multiple structure by using the iodide ion releasing method of the present invention.

(2) A grain in which one or more layers not completely covering a substrate grain are deposited on the substrate grain:

It is preferable to form the core layer or the outermost layer of a two-layered structure, a three-layered structure, a four-layered structure, a five-layered structure, . . . , or a multi-layered structure by using the iodide ion-releasing method of the present invention.

(3) A grain in which epitaxial growth is performed at selected portions of a substrate grain:

It is preferable to form the epitaxial portions on the corners, the edges, and the major faces of a grain by using the iodide ion releasing method of the present invention.

It is preferable that the compositions of the covering shells, the deposited layers, and the epitaxial portions of a silver halide containing silver iodide formed by the use of the iodide ion releasing method of the present invention have high silver iodide contents.

Although these silver halide phases may be any of silver iodide, silver bromoiodide, silver bromochloroiodide, and silver iodochloride, they are preferably silver iodide or silver bromoiodide, and more preferably silver iodide.

When the silver halide phase is silver bromoiodide, a silver iodide (iodide ion) content is preferably 1 to 45 mole %, more preferably 5 to 45 mole %, and most preferably 10 to 45 mole %.

If the silver iodide content is less than 1 mole %, the dye adsorption will not be increased sufficiently, the intrinsic sensitivity will not be improved sufficiently, and misfit required for introducing dislocation lines will not be formed. If the content exceeds 45 mole %, silver iodide can no longer be a solid solubility limit.

It is preferable to prepare silver halide grains containing dislocation lines by the use of the iodide ion releasing method of the present invention.

A dislocation line is a linear lattice defect at the boundary between a region already slipped and a region not slipped yet on a slip plane of crystal.

Dislocation lines in silver halide crystal are described in, e.g., 1) C. R. Berry. J. Appl. Phys., 27, 636 (1956), 2) C. R. Berry, D. C. Skilman, J. Appl. Phys., 35, 2165 (1964), 3) J. F. Hamilton, Phot. Sci. Eng., 11, 57 (1967), 4) T. Shiozawa, J. Soc. Sci. Jap., 34, 16 (1971), and 5) T. Shiozawa, J. Soc. phot. Sci. Jap., 35, 213 (1972). Dislocation lines can be analyzed by an X-ray diffraction method or a direct observation method using a low-temperature transmission electron microscope.

In direct observation of dislocation lines using a transmission electron microscope, silver halide grains, carefully taken out from an emulsion so as not to apply a pressure at which dislocation lines are produced in the grains, are placed on a mesh designed for use in electron microscopic observation, and are cooled in order to prevent damages (e.g., print out) due to electron rays. Then, the observation of the sample is performed by a transmission method.

In this case, as the thickness of a grain is increased, it becomes more difficult to transmit electron rays through it. Therefore, grains can be observed more clearly by using an electron microscope of a high voltage type (200 kV or more for a thickness of 0.25 μm).

The effects that dislocation lines have on photographic properties are described in G. C. Farnell, R. B. Flint, J. B. Chanter, J. Phot. Sci., 13, 25 (1965). This literature demonstrates that in tabular silver halide grains with a large size and a high aspect ratio, a location at which a latent image speck is formed has a close relationship to a defect in the grain.

JP-A-63-220238 and JP-A-1-201649 disclose tabular silver halide grains to which dislocation lines are introduced intentionally.

These patent applications indicate that tabular grains to which dislocation lines are introduced are superior to those having no dislocation lines in photographic characteristics, such as sensitivity and reciprocity law.

A method of introducing dislocation lines into a silver halide grain will be described.

In the present invention, it is preferable to introduce dislocation lines into a silver halide grain as follows.

That is, after silver halide grains serving as substrate grains are prepared, silver halide phases (silver halide covering shells, deposited layers, and epitaxial growth described above) containing silver iodide are formed on these substrate grains.

As mentioned above, it is preferable that the silver iodide contents of these silver halide phases be as high as possible.

The silver iodide content of the substrate grain is preferably 0 to 15 mole %, more preferably 0 to 12 mole %, and most preferably 0 to 10 mole %.

If the silver iodide content exceeds 15 mole %, the development rate will decrease in most cases. The silver iodide content is selected in accordance with the purpose for which the emulsion will be used.

A halogen amount to be added to form this high silver iodide content phase on the substrate grain is preferably 2 to 15 mole %, more preferably 2 to 10 mole %, and most preferably 2 to 5 mole % with respect to a silver amount of the substrate grain.

If the halogen content is less than 2 mole %, dislocation lines cannot be easily introduced into the grains. If the halogen Content exceeds 15 mole %, the development rate will decrease. The halogen content is selected in accordance with the purpose for which the emulsion will be used.

The high silver iodide content phase falls within a range of preferably 5 to 80 mole %, more preferably 10 to 70 mole %, and most preferably 20 to 60 mole % with respect to a silver amount of an overall grain.

If the high silver iodide content phase is less than 5 mole % or exceeds 80 mole %, dislocation lines cannot easily be introduced into the grains to increase the sensitivity of the emulsion.

A location on the substrate grain where the high silver iodide content phase is to be formed can be selected as desired. Although the high silver iodide content phase can be formed to cover the substrate grain or in a particular portion, it is preferable to control the positions of dislocation lines inside a grain by epitaxially growing the phase at a specific portion selected.

In this case, it is possible to freely select the composition of a halogen to be added, the addition method, the temperature of a reaction solution, the pAg, the solvent concentration, the gelatin concentration, and the ion intensity.

Thereafter, dislocation lines can be introduced by forming a silver halide shell outside the phases.

The composition of this silver halide shell may be any of silver bromide, a silver bromoiodide, and silver bromochloroiodide, but it is preferably silver bromide or silver bromoiodide.

When the silver halide shell consists of silver bromoiodide, the silver iodide content is preferably 0.1 to 12 mole %, more preferably 0.1 to 10 mole %, and most preferably 0.1 to 3 mole %.

If the silver iodide content is less than 0.1 mole %, the dye adsorption will not be increased sufficiently and the development will not be promoted sufficiently. If the content exceeds 12 mole %, the development rate will decrease.

In the above process of introducing dislocation lines, the temperature is preferably 30° to 80° C., more preferably 35° to 75° C., and most preferably 35° to 60° C.

If the temperature is lower than 30° C. or higher than 80° C., it can hardly be controlled in the apparatus employed in most cases. To control the temperature outside the range of 30° to 80° C., it would be necessary to use an apparatus having greater ability, which is undesirable in view of manufacturing cost.

A preferable pAg is 6.4 to 10.5.

In the case of regular-crystal grains, as well, the positions and the numbers of dislocation lines of individual grains viewed in a direction perpendicular to their major faces can be obtained from a photograph of the grains taken by using an electron microscope.

Note that dislocation lines can or cannot be seen depending on the angle of inclination of a sample with respect to electron rays. Therefore, in order to obverse dislocation lines without omission, it is necessary to obtain the positions of dislocation lines by observing photographs of the same grain taken at as many sample inclination angles as possible.

In the present invention, it is preferable to take five photographs of the same grain at inclination angles different by a 5° step by using a high-voltage electron microscope, thereby determining the positions and the number of dislocation lines.

It is desirable that dislocation lines be introduced into a regular-crystal grain.

Each regular-crystal grain has preferably 10 or more, more preferably 30 or more, and most preferably 50 or more dislocation lines when the dislocation lines are counted by the method using an electron microscope described above.

If dislocation lines are densely present or cross each other, it is sometimes impossible to accurately count the dislocation lines per grain.

Even in this case, however, dislocation lines can be roughly counted to such an extent as in units of tens, such as 10, 20 and 30.

It is desirable that the quantity distribution of dislocation lines between individual regular-crystal grains be uniform.

In the present invention, when dislocation lines are to be introduced into regular-crystal grains, the grains each having 10 or more dislocation lines in its fringe portion preferably occupy 100 to 50% (number), more preferably 100 to 70%, and most preferably 100 to 90% of all grains.

If such tabular grains occupy less than 50% of all grains, the grains will fail to have desired uniformity.

In the present invention, in order to obtain the ratio of grains containing dislocation lines and the number of dislocation lines, it is preferable to directly observe dislocation lines for at least 100 grains, more preferably 200 grains or more, and most preferably 300 grains or more.

It is preferable to prepare the outermost shell near the surface of a silver halide grain by using the iodide ion-releasing method of the present invention.

Forming a silver halide phase containing silver iodide near the surface of a grain is important in enhancing a dye absorbing force and controlling a developing rate.

In the present invention, the "surface of a grain" means a region at a depth of about 50 Å from the surface of a grain.

The halogen composition in such a region can be measured by a surface analysis method, such as XPS (X-ray photoelectron spectroscopy) or ISS (ion scattering spectroscopy).

In the present invention, the silver iodide content of a silver halide phase formed on the surface of an emulsion grain measured by these surface analysis methods is preferably 0.1 to 15 mole %, more preferably 0.3 to 12 mole %, particularly preferably 1 to 10 mole %, and most preferably 3 to 8 mole %.

If the silver iodide content is less than 0.1 mole %, the dye adsorption will not be increased sufficiently and the development will not be promoted sufficiently. If the content exceeds 15 mole %, the development rate will decrease.

It is also desirable that the halogen compositions of whole grains be uniform between individual grains.

In the present invention, the variation coefficient of the distribution of silver iodide contents between individual emulsion grains is preferably 20% or less, more preferably 15% or less, and most preferably 10% or less.

If the variation coefficient of the silver iodide content distribution exceeds 20%, the uniformity among the grains will be degraded.

The silver iodide contents of individual emulsion grains can be measured by analyzing the composition of each grain by using an X-ray microanalyzer.

The variation coefficient of a silver iodide content distribution is a value obtained by dividing a variation (standard deviation) of silver iodide contents of individual grains by an average silver iodide content.

A silver halide emulsion used in the present invention may be subjected to a treatment for rounding grains, as disclosed in European Patent 96,727B1 or European Patent 64,412B1, or surface modification, as disclosed in West German Patent 2,306,447C2 or JP-A-60-221320.

Although a flat grain surface is common, intentionally forming concavo-convex on the surface is preferable in some cases. Examples are a methods described in JP-A-58-106532 and JP-A-60-221320, in which a hole is formed in a portion of a crystal, e.g., the corner or the center of the face of a crystal, and a ruffle grain described in U.S. Pat. No. 4,643,966.

The grain size of an emulsion used in the present invention can be evaluated in terms of the equivalent-circle diameter of the projected area of a grain obtained by using an electron microscope, the equivalent-sphere diameter of the volume of a grain calculated from the projected area and the thickness of the grain, or the equivalent-sphere diameter of the volume of a grain obtained by a Coulter counter method. It is possible to selectively use various grains from a very fine grain having an equivalent-sphere diameter of 0.05 μm or less to a large grain having that of 10 μm or more. It is preferable to use a grain having an equivalent-sphere diameter of 0.1 μm to 3 μm as a light-sensitive silver halide grain.

For regular-crystal emulsions of, it is possible to use a so-called polydispersed emulsion having a wide grain size distribution or a monodispersed emulsion having a narrow grain size distribution in accordance with the intended use. As a measure representing the size distribution, a variation coefficient of either the equivalent-circle diameter of the projected area of a grain or the equivalent-sphere diameter of the volume of a grain is sometimes used. When a monodispersed emulsion is to be used, it is desirable to use an emulsion having a size distribution with a variation coefficient of preferably 25% or less, more preferably 20% or less, and most preferably 15% or less.

The monodispersed emulsion is sometimes defined as an emulsion having a grain size distribution in which 80% or more of all grains fall within a range of ±30% of an average grain size represented by the number or the weight of grains. In order for a light-sensitive material to satisfy its target gradation, two or more monodispersed silver halide emulsions having different grain sizes can be mixed in the same emulsion layer or coated as different layers in an emulsion layer having essentially the same color sensitivity. It is also possible to mix, or coat as different layers, two or more types of polydispersed silver halide emulsions or monodispersed emulsions together with polydisperse emulsions.

Photographic emulsions used in the present invention and other photographs emulsions used together with the photographic emulsions of the resent invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt, any of a single-jet method, a double-jet method, and a combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, European Patent 273,429 and European Patent 273,430, and West German Laid-Open Patent 3,819,241. This method is an effective grain formation method. To convert into a silver salt which can hardly be dissolved, it is possible to add a solution of a soluble halogen salt or silver halide grains. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757 and 4,242,445. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Laid-Open Patents 2,556,885 and 2,555,364.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of silver and a halide salt or can be introduced to the reactor vessel simultaneously with addition of a halide salt, a silver salt, or a deflocculant. Alternatively, ripening agents can be independently added in the step of adding a halide salt and a silver salt.

Examples of the ripening agent are ammonia, thiocyanate (e.g., potassium rhodanite and ammonium rhodanite), an organic thioether compound (e.g., a compound described in U.S. Pat. Nos. 3,574,628, 3,021,215, 3,057,724, 3,038,805, 4,276,374, 4,297,439, 3,704,130, or 4,782,013 and JP-A-57-104926), a thione compound (e.g., a tetra-substituted thiourea described in JP-A-53-82408, JP-A-55-77737, or U.S. Pat. No. 4,221,863, or a compound described in JP-A-53-144319), mercapto compounds capable of accelerating growth of silver halide grains, described in JP-A-57-202531, and an amine compound (e.g., JP-A-54-100717).

It is advantageous to use gelatin as a protective colloid for use in preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; a cellulose derivative, such as hydroxyethylcellulose, carboxymethylcellulose, and cellulose sulfates; sugar derivative, such as soda alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion of the present invention for a desalting purpose and disperse it in a newly prepared protective colloid dispersion. Although the temperature of washing can be selected in accordance with the intended use, it is preferably 5° C. to 50° C. Although the pH at washing can also be selected in accordance with the intended use, it is preferably 2 to 10, and more preferably 3 to 8. The pAg at washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion of the present invention, it is preferable to make salt of metal ion exist during grain formation, desalting, or chemical sensitization, or before coating in accordance with the intended use. The metal ion salt is preferably added during grain formation in performing doping for grains, and after grain formation and before completion of chemical sensitization in modifying the grain surface or when used as a chemical sensitizer. The doping can be performed for any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of a salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in a combination of two or more types of them.

The metal compounds are preferably dissolved in water or an appropriate organic solvent, such as methanol or acetone, and added in the form of a solution. To stabilize the solution, an aqueous hydrogen halide solution (e.g., HCl and HBr) or an alkali halide (e.g., KCl, NaCl, KBr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In formation of silver halide grains of the present invention, at least one of sulfur sensitization, selenium sensitization, gold sensitization, palladium sensitization or noble metal sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the location of a chemical sensitization speck can be selected in accordance with the intended use. It is, however, generally preferable to form at least one type of a chemical sensitization speck near the surface.

One chemical sensitization which can be preferably performed in the present invention is chalcogen sensitization, noble metal sensitization, or a combination of these. The sensitization can be performed by using an active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and x represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate salt or selenocyanate salt.

Examples of a sulfur sensitizer are hypo, a thiourea-based compound, a rhodanine-based compound, and sulfur-containing compounds described in U.S. Pat. Nos. 3,857,711, 4,266,018, and 4,054,457.

It is preferable to also perform gold sensitization for emulsions of the present invention. An amount of a gold sensitizer is preferably $1\times10^{-4}$ to $1\times10^{-7}$ mole, and more preferably $1\times10^{-5}$ to $5\times10^{-7}$ mole per mole of a silver halide. A preferable amount of a palladium compound is $1\times10^{-3}$ to $5\times10^{-7}$ mole per mole of a silver halide. A preferable amount of a thiocyan compound or a selenocyan compound is $5\times10^{-2}$ to $1\times10^{-6}$ mole per mole of a silver halide.

An amount of a sulfur sensitizer with respect to silver halide grains of the present invention is preferably $1\times10^{-4}$ to $1\times10^{-7}$ mole, and more preferably $1\times10^{-5}$ to $5\times10^{-7}$ mole per mole of a silver halide.

Selenium sensitization is a preferable sensitizing method for emulsions of the present invention. Known unstable selenium compounds are used in the selenium sensitization. Practical examples of the selenium compound are colloidal metal selenium, selenoureas (e.g., N,N-dimethylselenourea and N,N-diethylseleno urea), selenoketones, and selenoamides. In some cases, it is preferable to perform the selenium sensitization in combination with one or both of the sulfur sensitization and the noble metal sensitization.

The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferable in that the level of reduction sensitization can be minutely adjusted.

Known examples of the reduction sensitizer are stannous chloride, ascorbic acid and its derivative, amines and polyamines, a hydrazine derivative, form-amidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10^{-3}$ mole per mole of a silver halide.

The reduction sensitizers are dissolved in water or an organic solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process of manufacturing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion thus produced may form a silver salt hardly soluble in water, such as a silver halide, silver sulfide, or silver selenide, or a silver salt readily soluble in water, such as silver nitrate. The oxidizer for silver may be either an inorganic or organic substance. Examples of the inorganic oxidizer are ozone, hydrogen peroxide and its adduct (e.g., $NaBO_2$ $H_2O_2$ $3H_2O$, $2NaCO_3$ $3H_2O_2$, $Na_4P_2O_7$ $2H_2O_2$, and $2Na_2SO_4$ $H_2O_2$ $2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4]$ $3H_2O$, $4K_2SO_4$ $Ti(O_2)OH$ $SO_4$ $2H_2O$, and $Na_3[VO(O_2)(C_2H_4)_2$ $6H_2O)$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound which releases active halogen (e.g., N-bromosuccinimide, chloramine T, and chloramine B).

Preferable oxidizers of the present invention are an inorganic oxidizer such as ozone, hydrogen peroxide and its adduct, a halogen element, or thiosulfonate salt, and an organic oxidizer such as quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be performed during grain formation or chemical sensitization.

Photographic emulsions used in the present invention may contain various compounds in order to prevent fog during the manufacturing process, storage, or photographic processing of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7-)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methine dyes and the like, in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be contained in these dyes. Examples of a nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus, and a quinoline nucleus. These nuclei may have a substitutent on a carbon atom.

It is possible for a merocyanine dye or a composite merocyanine dye to have a 5- or 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

Emulsions may contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same time as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds described above can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

The addition amount of the spectral sensitizing dye may be $4\times10^{-6}$ to $8\times10^{-3}$ mole per mole of a silver halide. However, for a more preferable silver halide grain size of 0.2 to 1.2 μm, an addition amount of about $5\times10^{-5}$ to $2\times10^{-3}$ mole per mole of a silver halide is more effective.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in west German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities or speeds may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

As described above, various layer configurations and arrangements can be selected in accordance with the application of the light-sensitive material.

Not only the additives described above, but also other additives are used in the light-sensitive material according to the present invention, in accordance to the application of the material.

These additives are described in Research Disclosure Item 17643 (December 1978), Research Disclosure Item 18716 (November 1979), and Research Disclosure Item 308119 (December 1989), as is listed in the following table:

| Additive | RD17643 | RD18716 | RD308119 |
|---|---|---|---|
| 1. Chemical sensitizers | page 23 | page 648, right column | page 996 |
| 2. Sensitivity-increasing agents | | page 648, right column | |
| 3. Spectral sensitizers, super-sensitizers | pp. 23–24 | page 648, right column to page 649, right column | page 996, right column to page 998 right column |
| 4. Brighteners | page 24 | page 648, right column | page 998, right column |
| 5. Antifoggants, stabilizers | pp. 24–25 | page 649, right column | page 988 right column to page 1000, right column |
| 6. Light absorbent, filter dye, ultra-violet absorbents | pp. 25–26 | page 649, right column to page 650, left column | page 1003, left column to page 1003, right column |
| 7. Stain-preventing agents | page 25, right column | page 650, left-right columns | page 1002, right column |
| 8. Dye image-stabilizer | page 25 | page 650, left column | page 1002, right column |
| 9. Hardening agents | page 26 | page 651, left column | page 1004, right column to page 1005 left column |
| 10. Binder | page 26 | page 651, left column | page 1003, right column to page |

-continued

| Additive | RD17643 | RD18716 | RD308119 |
|---|---|---|---|
| | | | 1004, right column |
| 11. Plasticizers, lubricants | page 27 | page 650, right column | page 1006, left column to page 1006, right column |
| 12. Coating aids, surface active agents | pp. 26–27 | page 650, right column | page 1005, left column to page 1006, left column |
| 13. Antistatic agents | page 27 | page 650, right column | page 1006, right column to page 1007, left column |
| 14. Matting agent | | | page 1008, left column to page 1009, left column |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

Various color couplers can be used in the present invention, and specific examples of these couplers are described in patents described in the above-mentioned RD No. 17643, VII-C to VII-G and RD No. 308119, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glycerol-tributyrate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper. Further, the present invention is effectively applied to a film unit equipped with a lens disclosed in JP-B-2-32615 or Examined Published Japanese Utility Model Application (JU-B) 3-39782.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 seconds or less, and more preferably, 20 seconds or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness − film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-β-hydroxyethylaniline, sulfates are preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

$$\text{Aperture} = \{\text{contact area } (cm^2) \text{ of processing solution with air}\}/\{\text{volume } (cm^3) \text{ of the solution}\}$$

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds descried in West German Patents 966,410 and 2,748,430; polyamine compounds described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

Further, the silver halide light-sensitive material of the present invention can be applied also to a heat-developing light-sensitive material as disclosed in, e.g., U.S. Pat. No. 4,500,626, JP-A-60-133449, JP-A-59-218443, JP-A-61-238056, and European Patent 210,660A2.

The silver halide color light-sensitive material of the present invention exerts its advantages more effectively when applied to a film unit equipped with a lens disclosed in JP-B-2-32615 or Examined Published Japanese Utility Model Application (JU-B) 3-39782.

EXAMPLES

The present invention will be described in greater detail below by way of its examples, but the present invention is not limited to these examples.

Example 1

Four types of seed crystals H to K were prepared which had a volume-weighted sphere equivalent diameter of 0.40 μm. The seed crystals H were irregular, potato-like grains and had a relatively broad size distribution (variation coefficient: 18%). The seed crystals I were octahedral grains having rounded corners (85% of the surface was of (111) face) and had a narrow size distribution (variation coefficient: about 12%). The seed crystals J were tetradecahedral grains (50% of the surface was of (111) face) and had a relatively broad size distribution (variation coefficient: 15%). The seed crystals K were cubic grains having their corners chipped off (80% of the surface was of (100) face) and had a narrower size distribution (variation coefficient: 8%) than any other seed crystals prepared. The seed crystals H to K were all silver bromoiodide grains which had been formed to have an average iodide content of 2 mole %.

These seed crystals were dissolved in 15 liters of distilled water, and the resultant solution were heated to 60° C. and vigorously stirred after the silver potential (vs SCE) and the pH had been adjusted to −20 mV and 5, respectively. Next, a high-iodide layer was grown on each seed crystal under a selected one of the conditions A to G which will be specified below, and the silver potential and the pH were adjusted again to −20 mV and 5. Thereafter, the solution was heated to 75° C., growing a low-iodide layer was on the seed crystal (iodide content of 1 mole %). As a result, the emulsions L to X shown in Table 3 (later presented) were prepared, two of which contained potato-like grains having a diameter of 0.5 μm, five of which contained octahedral grains (80% of the surface was of (111) face), two of which contained tetradecahedral grains (50% of the surface was of (111) face), and the remaining five of which contained cubic grains (85% of the surface was of (100) face). Of each grain of any emulsion thus prepared, the seed crystal, the high-iodide layer and the low-iodide layer had silver amounts in the ratio of 50:5:45.

Conditions for Growing High-Iodide Layer

A. A 5% aqueous potassium iodide was continuously added to the solution over 10 minutes.

B. An emulsion having fine AgI grains having a diameter of 0.02 μm was added to the solution and dissolved completely over 10 minutes.

C. An aqueous solution of an iodide ion-releasing agent (compound 11) was added to the solution, an aqueous NaOH solution was added, and iodide ions were released from the compound 11 over 10 minutes, while controlling the pH within the range of 5.0 to 8.5. (The pH was controlled such that 50% of the compound 11 released the iodide ions within 5 minutes from the start of raising the pH.)

D. The process D was performed following the same procedures as for the process C described above, except the following.

Iodide ions were released from the compound 11 over 4 minutes, while controlling the pH within the range of 5.0 to 9.5 instead of 5.0 to 8.5. (The pH was controlled such that 50% of the compound 11 released the iodide ions within 2 minutes from the start of raising the pH.)

E. An aqueous solution of an iodide ion-releasing agent (compound 58) was added to the solution, an aqueous sodium p-toluenesulfinate (3-times mole) solution was added to the solution, and iodide ions were released from the compound 58 over 10 minutes. (Iodide ions were released from 50% of the compound 58 within 10 seconds from the time sodium p-toluenesulfinate was added to the solution.)

F. The process F was performed following the same procedures as for the process E described above, except the following.

After an aqueous sodium sulfite (1.2 times mole) solution was added in place of the aqueous sodium p-toluenesulfinate (3-times mole) solution, an aqueous NaOH solution was added to the solution, thereby raising the pH to 9.0, iodide ions were released form the compound 58 over 8 minutes while maintaining the pH at 9.0, and then returned to 5.0. (Iodide ions were released from 50% of the compound 58 within 5 seconds from the time the pH was raised to 9.0.)

The rate of iodide ion release was measured in the following method.

First, the emulsion grains were separated from the solution by centrifugal separation. Next, the amount of the unreacted iodide ion-releasing agent contained in the supermatant liquid was determined by ICP (Inductively Coupled Plasma-Emission) analysis. Then, the rate of iodide ion release was measured from the changes in the amount of the unreacted iodide ion-releasing agent.

Each of the emulsions L to X was desalted, and then re-dispersed, thereby adjusting the pH and the pAg to 6.0 and 8.8, respectively. Thereafter, the emulsions L to Y were subjected to optimal chemical sensitization using the chemical sensitizer of thiocyanic acid, selenocyanic acid, chloroauric acid, thiosulfonic acid and selenourea, in the presence of spectral sensitizing dyes ExS-1, -2 and -3 and compounds F-6, F-12 and F-14.

These emulsions were coated, in the amounts shown in Table 1, on triacetylcellulose film supports having undercoated layers, thereby making coated samples containing the emulsion and protective layer.

TABLE 1

| 1. Emulsion Coating Conditions | |
|---|---|
| (1) Emulsion layer | |
| Emulsions: Each emulsions | (silver $3.6 \times 10^{-2}$ mole/m$^2$) |
| Coupler represented by formula below | ($1.5 \times 10^{-3}$ mole/m$^2$) |

TABLE 1-continued

| 1. Emulsion Coating Conditions | |
|---|---|
| 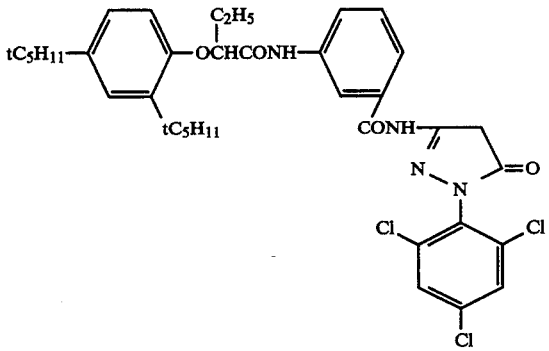 | |
| Tricresylphosphate | (1.10 g/m$^2$) |
| Gelatin | (2.30 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours, exposed through a continuous wedge for 1/100 second, and subjected to the color development specified below:

2. Exposure and Process Conditions

The densities of the samples thus processed were measured through a green filter.

| Process | Time | Temperature |
|---|---|---|
| Color development | 2 min. 00 sec. | 40° C. |
| Bleach-fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The compositions of the individual processing solutions are given below.

| (Color developing solution) | (g) |
|---|---|
| Diethylenetriaminepentaacetic acid | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |

-continued

| (Color developing solution) | (g) |
|---|---|
| 4-[N-ethyl-N-β-hydroxylethylamino]-2-methylaniline sulfate | 4.5 |
| Water to make | 1.0 L |
| pH | 10.05 |

(Bleach-fixing Solution)

This solution had the composition specified in Table 2:

TABLE 2

| | |
|---|---|
| Ferric ammonium ethylenediamine-tetraacetate dihydrate | 90.0 |
| Disodium ethylenediaminetetraacetate | 5.0 |
| Sodium sulfite | 12.0 |
| Ammonium thiosulfate aqueous solution (70%) | 260.0 ml |
| Acetic acid (98%) | 5.0 ml |
| Bleaching accelerator represented by formula below | 0.01 mole |
| 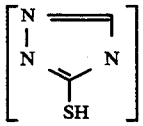 | |
| Water to make | 1.0 L |
| pH | 6.0 |

(Washing Solution)

Tap water was supplied to a mixed-bed column filled with an H-type strongly acidic cation exchange resin (Amberlite IR-120B: available from Rohm & Haas Co. ) and an OH type strongly basic anion exchange resin (Amberlite IR-400) to set the concentrations of calcium and magnesium to be 3 mg/L or less. Subsequently, 20 mg/L of sodium isocyanurate dichloride and 1.5 g/L of sodium sulfate were added.

The pH of the solution fell within the range of 6.5 to 7.5.

| (Stabilizing solution) | (g) |
|---|---|
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 L |
| pH | 5.0–8.0 |

The sensitivity is represented by a relative value of the logarithm of the reciprocal of an exposure amount (lUX sec) at which a density of fog+0.2 is given.

The obtained results are summarized in Table 3.

TABLE 3

| Sample No. | Emulsion | Grain shape | Condition for growing high-iodide layer | Sensitivity | Fog | |
|---|---|---|---|---|---|---|
| 1 | Em-L | Potato-like | Ⓐ | 102 | 0.20 | Comparative Example |
| 2 | M | Potato-like | Ⓓ | 108 | 0.20 | Comparative Example |
| 3 | N | Octahedral | Ⓐ | 100 | 0.18 | Comparative Example |
| 4 | O | Octahedral | Ⓑ | 102 | 0.19 | Comparative Example |
| 5 | P | Octahedral | Ⓒ | 108 | 0.19 | Comparative Example |
| 6 | Q | Octahedral | Ⓓ | 125 | 0.16 | Present Invention |
| 7 | R | Octahedral | Ⓕ | 134 | 0.16 | Present |

TABLE 3-continued

| Sample No. | Emulsion | Grain shape | Condition for growing high-iodide layer | Sensitivity | Fog | |
|---|---|---|---|---|---|---|
| 8 | S | Tetradecahedral | Ⓓ | 120 | 0.17 | Invention Present Invention |
| 9 | T | Tetradecahedral | Ⓕ | 129 | 0.18 | Invention Present Invention |
| 10 | U | Cubic | Ⓐ | 105 | 0.22 | Comparative Example |
| 11 | V | Cubic | Ⓑ | 105 | 0.22 | Comparative Example |
| 12 | W | Cubic | Ⓔ | 129 | 0.18 | Present Invention |
| 13 | X | Cubic | Ⓕ | 138 | 0.17 | Present Invention |

As is apparent from Table 3, the samples according to the present invention had low fog and high sensitivities.

Example 2

Emulsions L', M', P', R', U', and Y', each containing small grains having a diameter of 0.3 μm, were prepared in the same way as the emulsions L, M, P, R, U, and Y of Example 1, except that used was made of seed crystals having a diameter of 0.24 μm. A plurality of layers having the compositions presented below were coated an undercoated triacetylcellulose film supports, making various multi-layer light-sensitive materials. The emulsions A and B used in the third layer of one of the samples were replaced by the emulsions L and L', respectively, thereby making a sample 101. Similarly, the emulsions A and B used in the third layer of other five of the samples were replaced by the emulsions M and M', the emulsions P and P', the emulsions R and R', the emulsions U and U', and the emulsions Y and Y', thereby making samples 102, 103,104, 105, and 106.

(Compositions of Light-sensitive Layers)

The main materials used in the individual layers are classified as follows.

ExC: Cyan coupler UV: Ultraviolet absorbent

ExM: Magenta coupler HBS: High-boiling organic solvent

ExY: Yellow coupler H: Gelatin hardener

ExS: Sensitizing dye

The number corresponding to each component indicates the coating amount in units of g/m². The coating amount of a silver halide is represented by the coating amount of silver. The coating amount of each sensitizing dye is represented in units of moles per mole of a silver halide in the same layer.

| | |
|---|---|
| 1st layer (Antihalation layer) | |
| Black colloidal silver silver | 0.18 |
| Gelatin | 1.40 |
| ExM-1 | 0.18 |
| ExF-1 | $2.0 \times 10^{-3}$ |
| 2nd layer (Interlayer) | |
| Emulsion G silver | 0.065 |
| 2,5-di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| 3rd layer (Low-speed red-sensitive emulsion layer) | |
| Emulsion A silver | 0.25 |
| Emulsion B silver | 0.25 |

-continued

| | |
|---|---|
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-4 | 0.17 |
| ExC-7 | 0.020 |
| UV-1 | 0.070 |
| UV-2 | 0.050 |
| UV-3 | 0.070 |
| HBS-1 | 0.60 |
| Gelatin | 0.87 |
| 4th layer (Medium-speed red-sensitive emulsion layer) | |
| Emulsion D silver | 0.80 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.20 |
| ExC-2 | 0.050 |
| ExC-4 | 0.20 |
| ExC-5 | 0.050 |
| ExC-7 | 0.015 |
| UV-1 | 0.070 |
| UV-2 | 0.050 |
| UV-3 | 0.070 |
| Gelatin | 1.30 |
| 5th layer (High-speed red-sensitive emulsion layer) | |
| Emulsion E silver | 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.097 |
| ExC-2 | 0.010 |
| ExC-3 | 0.065 |
| ExC-6 | 0.020 |
| HBS-1 | 0.22 |
| HBS-2 | 0.10 |
| Gelatin | 1.63 |
| 6th layer (Interlayer) | |
| Cpd-1 | 0.040 |
| HBS-1 | 0.020 |
| Gelatin | 0.80 |
| 7th layer (Low-speed green-sensitive emulsion layer) | |
| Emulsion C silver | 0.30 |
| ExS-4 | $2.6 \times 10^{-5}$ |
| ExS-5 | $1.8 \times 10^{-4}$ |
| ExS-6 | $6.9 \times 10^{-4}$ |
| ExM-1 | 0.021 |
| ExM-2 | 0.26 |
| ExM-3 | 0.030 |
| ExY-1 | 0.025 |
| HBS-1 | 0.10 |
| HBS-3 | 0.010 |
| Gelatin | 0.63 |
| 8th layer (Medium-speed green-sensitive emulsion layer) | |
| Emulsion D silver | 0.55 |
| ExS-4 | $2.2 \times 10^{-5}$ |
| ExS-5 | $1.5 \times 10^{-4}$ |

-continued

| | |
|---|---|
| ExS-6 | $5.8 \times 10^{-4}$ |
| ExM-2 | 0.094 |
| ExM-3 | 0.026 |
| ExY-1 | 0.018 |
| HBS-1 | 0.16 |
| HBS-3 | $8.0 \times 10^{-3}$ |
| Gelatin | 0.50 |
| 9th layer (High-speed green-sensitive emulsion layer) | |
| Emulsion E silver | 1.55 |
| ExS-4 | $4.6 \times 10^{-5}$ |
| ExS-5 | $1.0 \times 10^{-4}$ |
| ExS-6 | $3.9 \times 10^{-4}$ |
| ExC-1 | 0.015 |
| ExM-1 | 0.013 |
| ExM-4 | 0.065 |
| ExM-5 | 0.019 |
| HBS-1 | 0.25 |
| HBS-2 | 0.10 |
| Gelatin | 1.54 |
| 10th layer (Yellow filter layer) | |
| Yellow colloidal silver silver | 0.035 |
| Cpd-1 | 0.080 |
| HBS-1 | 0.030 |
| Gelatin | 0.95 |
| 11th layer (Low-speed blue-sensitive emulsion layer) | |
| Emulsion C silver | 0.18 |
| ExS-7 | $8.6 \times 10^{-4}$ |
| ExY-1 | 0.042 |
| ExY-2 | 0.72 |
| HBS-1 | 0.28 |
| Gelatin | 1.10 |
| 12th layer (Medium-speed blue-sensitive emulsion layer) | |
| Emulsion D silver | 0.40 |
| ExS-7 | $7.4 \times 10^{-4}$ |
| ExC-7 | $7.0 \times 10^{-3}$ |
| ExY-2 | 0.15 |
| HBS-1 | 0.050 |
| Gelatin | 0.78 |
| 13th layer (Medium-speed blue-sensitive emulsion layer) | |
| Emulsion F silver | 0.70 |
| ExS-7 | $2.8 \times 10^{-4}$ |
| ExY-2 | 0.20 |
| HBS-1 | 0.070 |
| Gelatin | 0.69 |
| 14th layer (First protective layer) | |
| Emulsion G silver | 0.20 |
| UV-4 | 0.11 |
| UV-5 | 0.17 |
| HBS-1 | $5.0 \times 10^{-2}$ |
| Gelatin | 1.00 |
| 15th layer (Second protective layer) | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

In addition to the above components, to improve storage stability, processability, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, and rhodium salt.

The emulsions represented above by the symbols are listed in the following Table 4:

TABLE 4

| Emulsion | Average AgI content (%) | Average grain size (μm) | Variation coefficient (%) according to grain size | Diameter/thickness ratio | Silver amount ratio [core/intermediate/shell] (AgI content) | Grain structure/shape |
|---|---|---|---|---|---|---|
| C | 2.0 | 0.55 | 25 | 7 | — | Uniform structure tabular grain |
| D | 9.0 | 0.65 | 25 | 6 | [12/59/29] (0/11/8) | Triple structure tabular grain |
| E | 9.0 | 0.85 | 23 | 5 | [8/59/33] (0/11/8) | Triple structure tabular grain |
| F | 14.5 | 1.25 | 25 | 3 | [37/63] (34/3) | Double structure plate-like grain |
| G | 1.0 | 0.07 | 15 | 1 | — | Uniform structure fine grain |

In Table 4:

(1) The emulsions C to F were subjected to reduction sensitization during grain preparation by using thiourea dioxide and thiosulfonic acid in accordance with the Examples in JP-A-2-191938.

(2) The emulsions C to F were subjected to gold sensitization, sulfur sensitization, and selenium sensitization in the presence of the spectral sensitizing dyes described in the individual light-sensitive layers and sodium thiocyanate in accordance with the Examples in JP-A-3-237450.

(3) The preparation of tabular grains was per formed by using low-molecular weight gelatin in accordance with the Examples in JP-A-l-158426.

(4) Dislocation lines as described in JP-A-2-34090 were observed in tabular grains and regular-crystal grains having a grain structure when a high-voltage electron microscope was used.

The compounds used in the layers described above are as follows:

ExC-1

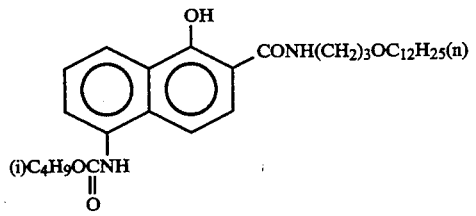

-continued
ExC-2
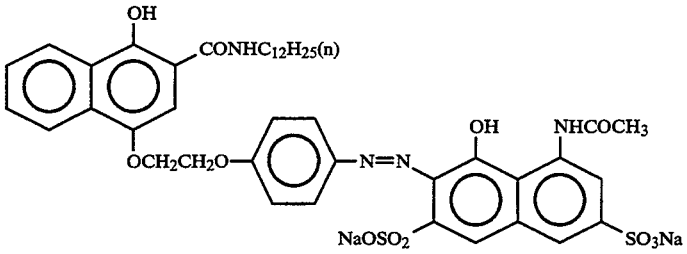
ExC-3
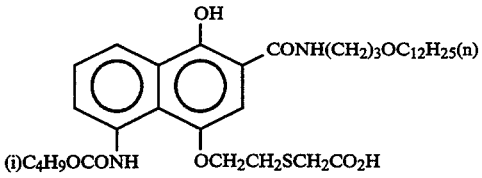
ExC-4
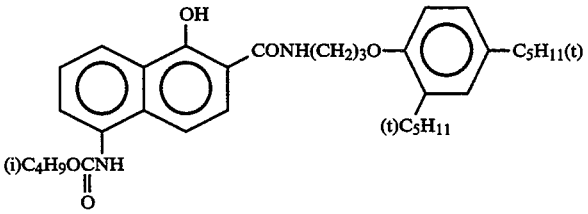
ExC-5
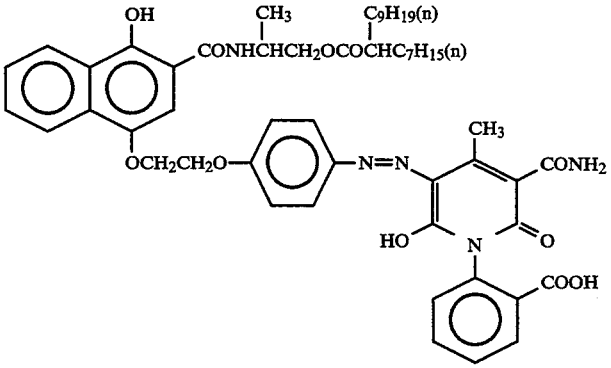
ExC-6
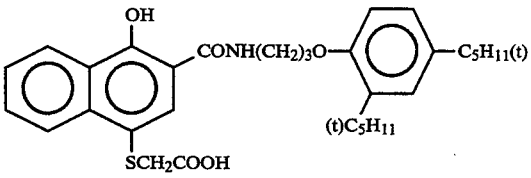

-continued
ExC-7
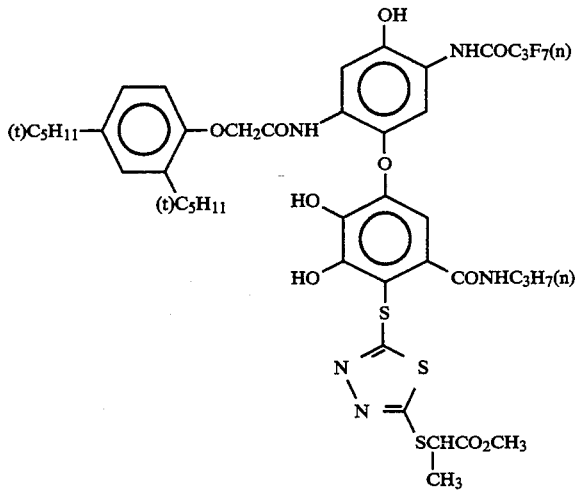
ExM-1
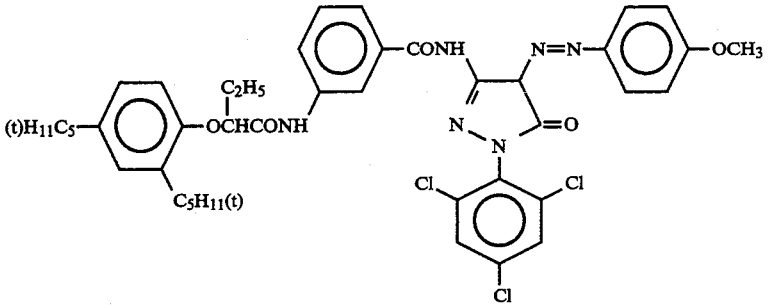
ExM-2
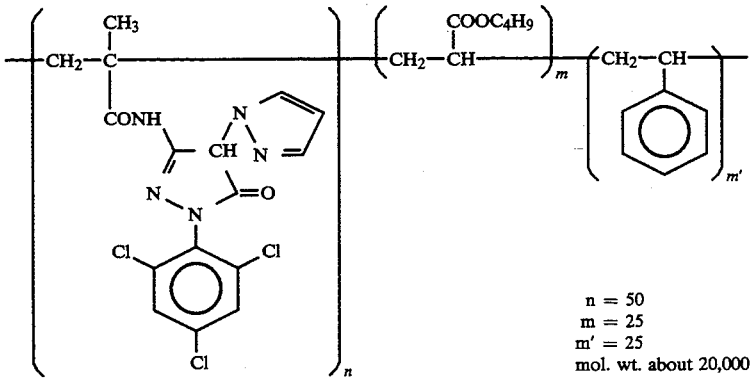
ExY-1
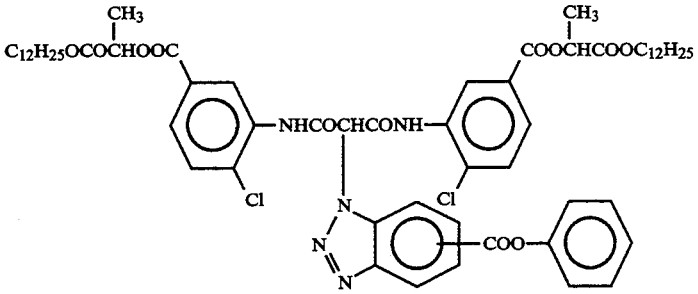

-continued
ExY-2
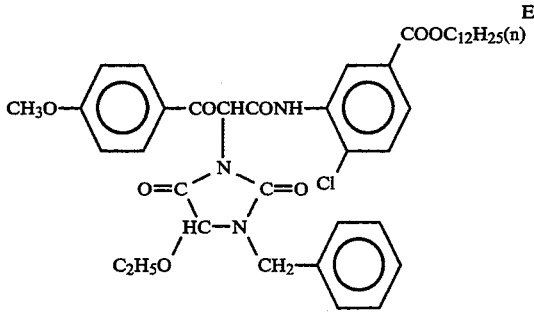
ExF-1
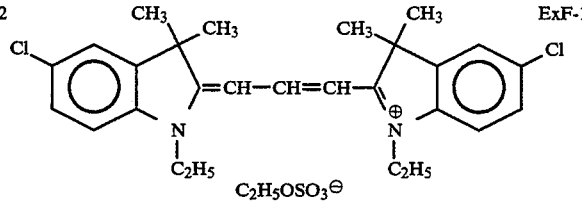
Cpd-1
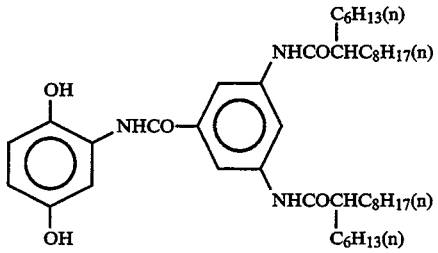
UV-1
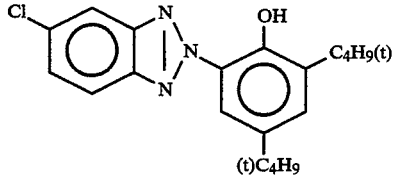
UV-2
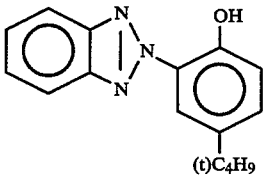
UV-3
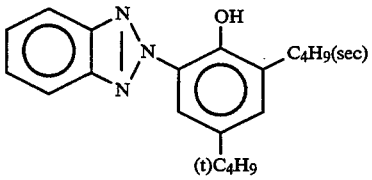
UV-4
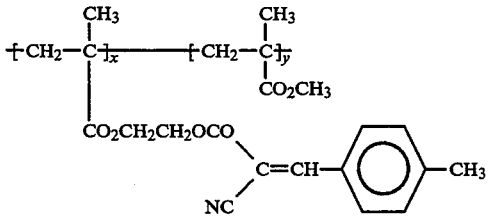
x:y = 70:30 (wt %)
UV-5
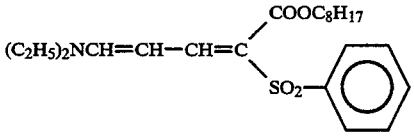
Tricresylphosphate HBS-1
Dibutylphthalate HBS-2
HBS-3
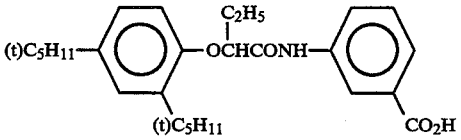
ExS-1
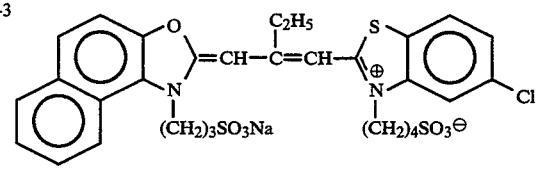
ExS-2
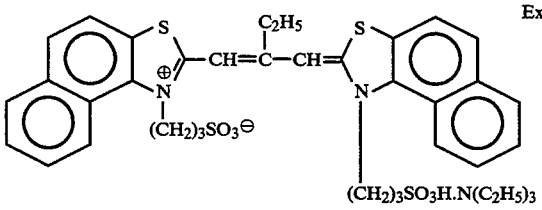
ExS-3
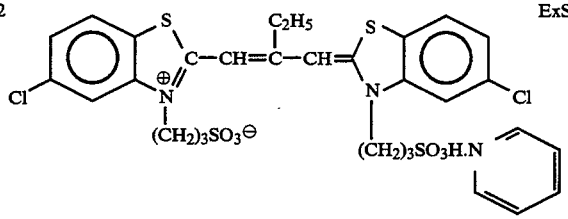
ExS-4
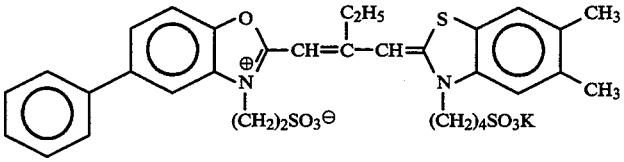

-continued
ExS-5
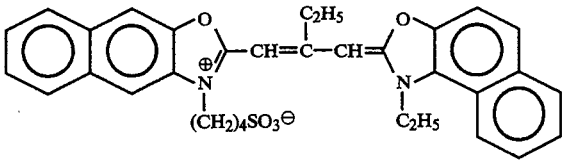
ExS-6
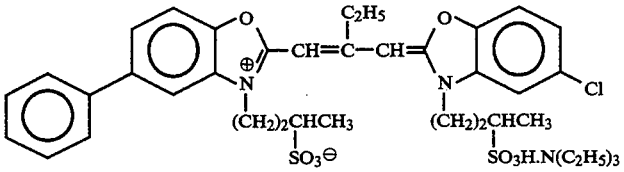
ExS-7
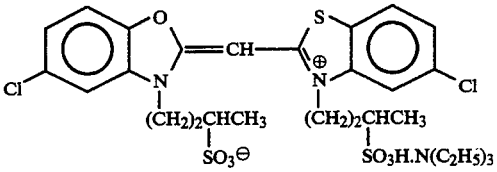
S-1
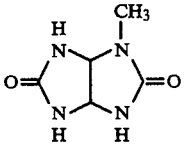
H-1
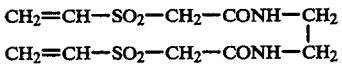
B-1
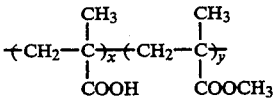
x/y = 10/90
B-2
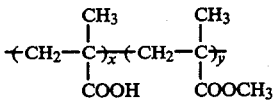
x/y = 40/60
B-3
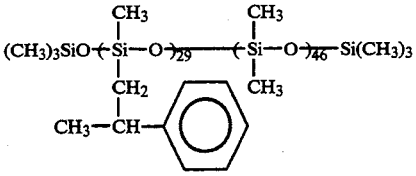
B-4
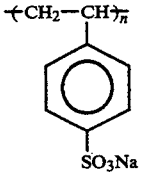
B-5
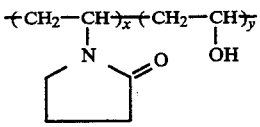
x/y = 70/30
B-6
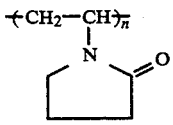
(mol. wt. about 10,000)
W-1
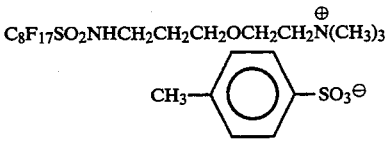
W-2
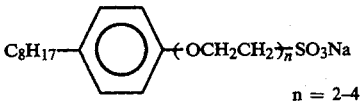
n = 2–4
W-3
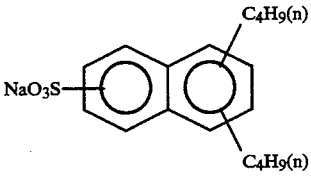
F-1
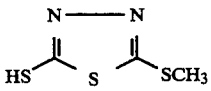
F-2
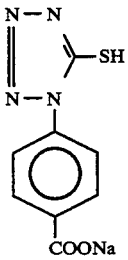

-continued

F-3

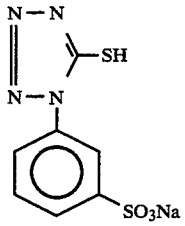

F-4

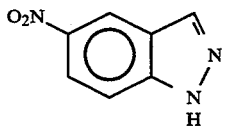

F-5

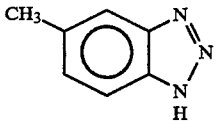

F-6

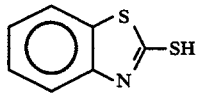

F-7

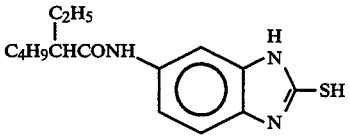

F-8

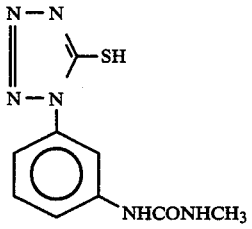

F-9

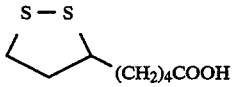

F-10

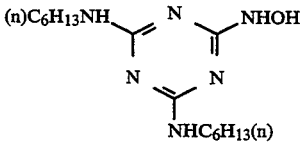

F-11

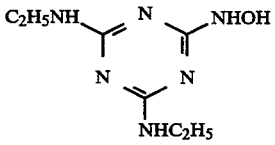

F-12

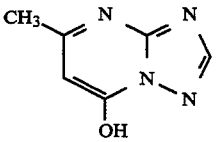

F-13

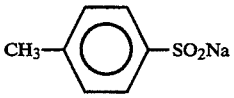

F-14

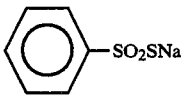

F-15

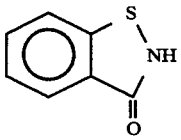

F-16

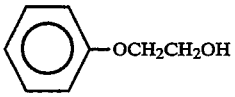

F-17

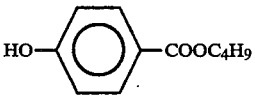

The samples 101 to 106, thus obtained, were exposed and processed by the method specified below:

| Processing Method | | |
|---|---|---|
| Process | Time | Temperature |
| Color development | 3 min. 15 sec. | 38° C. |
| Bleaching | 1 min. 00 sec. | 38° C. |
| Bleach-fixing | 3 min. 15 sec. | 38° C. |
| Washing (1) | 40 sec. | 35° C. |
| Washing (2) | 1 min. 00 sec. | 35° C. |
| Stabilization | 40 sec. | 38° C. |
| Drying | 1 min. 15 sec. | 55° C. |

The compositions of the individual processing solutions are given below.

| | (g) |
|---|---|
| (Color developing solution) | |
| Diethylenetriaminepentaacetic acid | 1.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxylethylamino]- | 4.5 |

-continued

| | (g) |
|---|---|
| 2-methylaniline sulfate | |
| Water to make | 1.0 L |
| pH | 10.05 |
| (Bleaching solution) | |
| Ferric ammonium ethylenediamine-tetraacetate dihydrate | 120.0 |
| Disodium ethylenediaminetetraacetate | 10.0 |
| Ammonium bromide | 100.0 |
| Ammonium nitrate | 10.0 |
| Bleaching accelerator represented by formula below | 0.005 mole |

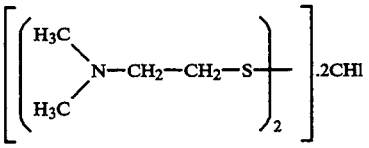

| | |
|---|---|
| Ammonia water (27%) | 15.0 ml |
| Water to make | 1.0 L |
| pH | 6.3 |
| (Bleach-fixing solution) | |
| Ferric ammonium ethylenediamine-tetraacetate dihydrate | 50.0 |
| Disodium ethylenediaminetetraacetate | 5.0 |
| Sodium sulfite | 12.0 |
| Ammonium thiosulfate aqueous solution (70%) | 240.0 ml |
| Ammonia water (27%) | 6.0 ml |
| Water to make | 1.0 L |
| pH | 7.2 |

(Washing Solution)

Tap water was supplied to a mixed-bed column filled with an H-type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution fell within the range of 6.5 to 7.5.

| (Stabilizing solution) | (g) |
|---|---|
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 L |
| pH | 5.0–8.0 |

The samples 104 and 106, which falls within the scope of the present invention, exhibited higher sensitivity and higher gradation than the comparative samples 101, 102, 103, and 105, in the high-density region (density: 1.5 or more) of the characteristic curve for the red-sensitive layer. It is clear that the emulsions according to the present invention impart excellent properties to a multi-layer color light-sensitive material, too.

As has been described, the present invention can provide a silver halide photographic light-sensitive material which has high sensitivity and low fog and which exhibits good photographic properties.

What is claimed is:

1. A silver halide photographic light-sensitive material comprising at least one light-sensitive silver halide emulsion layer formed on a support, said emulsion layer containing at least one silver halide emulsion which comprises regular crystal grains having a silver halide phase containing silver iodide, said silver halide phase having been formed while iodide ions are rapidly being generated in a reactor vessel, wherein said iodide ions are generated from an iodide ion-releasing agent represented by Formula (I):

$$R—I \qquad \text{Formula (I)}$$

where R represents a monovalent organic residue which releases the iodine atom in the form of ions upon reacting with a base and/or a nucleophilic reagent, which is placed in the reactor vessel, whereby 50% to 100% of said iodide ion-releasing agent completes release of said iodide ions within 180 consecutive seconds in said reactor vessel, and wherein said iodide ions are generated by a reaction of said iodide ion-releasing agent with an iodide ion release-controlling agent.

2. The light-sensitive material according to claim 1, wherein 60% or more of the surface of each regular crystal grain is (111) face.

3. The light-sensitive material according to claim 1, wherein 60% or more of the surface of each regular crystal grain is (100) face.

4. The light-sensitive material according to claim 1, wherein said reaction is a second-order reaction essentially proportional to a concentration of the iodide ion-releasing agent and a concentration of the iodide ion release controlling agent, and a rate constant of the second-order reaction is 1,000 to $5\times10^{-3}M^{-1}\ sec^{-1}$.

5. The light-sensitive material according to claim 1, wherein said iodide ions are generated from an iodide ion-releasing agent represented by Formula (II) below:

$$R_{21}—(\overset{R_{22}}{\underset{R_{22}}{C}})_{n_2}—I \qquad \text{Formula (II)}$$

where $R_{21}$ represents an electron-withdrawing group, each $R_{22}$ represents a hydrogen atom or a substitutable group, and $n_2$ represents an integer of 1 to 6.

6. The light-sensitive material according to claim 1, wherein said iodide ion-releasing agent is represented by Formula (III) below:

$$R_{31}—(\overset{R_{32}}{\underset{R_{32}}{C}})_{n_3}—I \qquad \text{Formula (III)}$$

where $R_{31}$ represents a $R_{33}O$— group, a $R_{33}S$— group, a $(R_{33})_2N$-group, a $(R_{33})_2P$— group, or a phenyl group, wherein $R_{33}$ represents a hydrogen atom, an alkyl group having 1 to 30 carbon atoms, an alkenyl group having 2 to 30 carbon atoms, an alkynyl group having 2 or 3 carbon atoms, an aryl group having 6 to 30 carbon atoms, an aralkyl group having 7 to 30 carbon atoms, or a heterocyclic group having 4 to 30 carbon atoms, with the proviso that when $R_{33}$ represents the $(R_{33})_2N$— group or $(R_{33})_2P$— group, the two $R_{33}$ group may be the same or different; each $R_{32}$ represents a hydrogen atom or a substitutable group; and $n_3$ represents an integer of 1 to 6.

7. The light-sensitive material according to claim 1, wherein 50% to 100% in number of all the grains is occupied by regular crystal grains having 10 or more dislocation lines per grain.

8. The light-sensitive material according to claim 1, wherein the grains contain silver iodide having a variation coefficient of a silver iodide content distribution between the grains is 3% to 20%.

* * * * *